US011846472B2

(12) United States Patent
Watanabe et al.

(10) Patent No.: US 11,846,472 B2
(45) Date of Patent: Dec. 19, 2023

(54) HEAT EXCHANGER

(71) Applicant: FUJITSU GENERAL LIMITED, Kanagawa (JP)

(72) Inventors: Masatoshi Watanabe, Kanagawa (JP); Yoshinari Maema, Kanagawa (JP); Ryo Takaoka, Kanagawa (JP); Kotaro Oka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 226 days.

(21) Appl. No.: 17/598,673

(22) PCT Filed: Jan. 31, 2020

(86) PCT No.: PCT/JP2020/003636
§ 371 (c)(1),
(2) Date: Sep. 27, 2021

(87) PCT Pub. No.: WO2020/202759
PCT Pub. Date: Oct. 8, 2020

(65) Prior Publication Data

US 2022/0196335 A1 Jun. 23, 2022

(30) Foreign Application Priority Data

Mar. 29, 2019 (JP) ..... 2019-065435

(51) Int. Cl.
*F28F 9/02* (2006.01)
*F28D 7/16* (2006.01)

(52) U.S. Cl.
CPC ..... *F28D 7/1653* (2013.01); *F28F 9/0204* (2013.01)

(58) Field of Classification Search
CPC ..... F28F 9/0202; F28F 9/0204; F28F 9/0207; F28F 9/0278
See application file for complete search history.

(56) References Cited

U.S. PATENT DOCUMENTS 7,111,669 B2 9/2006 Hoglinger et al.
9,518,788 B2 12/2016 Jindou et al.
(Continued)

FOREIGN PATENT DOCUMENTS

CN 1618002 5/2005
CN 202041023 11/2011
(Continued)

OTHER PUBLICATIONS

Notification to Grant Patent Right for Invention Issued in Corresponding CN Patent Application No. 202080026053.4, dated Jul. 27, 2022, along with an English translation thereof.
(Continued)

*Primary Examiner* — Eric S Ruppert
(74) *Attorney, Agent, or Firm* — Greenblum & Bernstein, P.L.C.

(57) ABSTRACT

A heat exchanger includes flat tubes, a header to which the flat tubes are connected, an inflow plate that separates a refrigerant inflow portion and a lower circulation portion, a vertical dividing plate that separates the lower circulation portion and an upper circulation portion, a lower dividing plate that divides the lower circulation portion into a lower ascent path on an internal side and a lower descent path of an external side, and an upper dividing plate that divides the upper circulation portion into an upper ascent path on a leeward side, and an upper descent path on a windward side, wherein the inflow plate includes an ejection hole on a leeward side and an internal side, and the vertical dividing plate includes a first passing port on a leeward side and an internal side, and a second passing port on a windward external side.

4 Claims, 10 Drawing Sheets

(56) References Cited

U.S. PATENT DOCUMENTS

| | | | |
|---|---|---|---|
| 10,041,710 | B2 | 8/2018 | Morimoto et al. |
| 10,436,527 | B2 | 10/2019 | Jindou et al. |
| 10,443,944 | B2 | 10/2019 | Inoue et al. |
| 2005/0006067 | A1 | 1/2005 | Hoglinger et al. |
| 2016/0169596 | A1 | 6/2016 | Jindou et al. |
| 2016/0223231 | A1 | 8/2016 | Morimoto et al. |
| 2016/0238322 | A1 | 8/2016 | Inoue et al. |
| 2016/0320135 | A1 | 11/2016 | Inoue et al. |
| 2016/0327317 | A1 | 11/2016 | Inoue et al. |
| 2017/0299284 | A1 | 10/2017 | Jindou et al. |
| 2020/0109902 | A1 | 4/2020 | Satou et al. |
| 2021/0018190 | A1* | 1/2021 | Hirokawa ..... F28F 9/0204 |

FOREIGN PATENT DOCUMENTS

| | | |
|---|---|---|
| CN | 102278908 | 12/2011 |
| CN | 105157441 | 12/2015 |
| CN | 105849498 | 8/2016 |
| CN | 106556184 | 4/2017 |
| CN | 106852169 | 6/2017 |
| EP | 1042639 | 10/2000 |
| EP | 3 425 320 | 1/2019 |
| JP | 2003-287390 | 10/2003 |
| JP | 2010-151381 | 7/2010 |
| JP | 2015-55405 | 3/2015 |
| JP | 2015-68623 | 4/2015 |
| JP | 2015-127618 | 7/2015 |
| JP | 2015-127619 | 7/2015 |
| JP | 5761252 | 8/2015 |
| JP | 2017-155992 | 9/2017 |
| JP | 2018-194251 | 12/2018 |
| WO | 2014/188714 | 11/2014 |
| WO | 2017/149989 | 9/2017 |
| WO | 2018/181338 | 10/2018 |

OTHER PUBLICATIONS

International Search Report issued in International Patent Application No. PCT/JP2020/003636, dated Mar. 17, 2020, along with an English translation thereof.

Extended European Search Report Issued in Corresponding EP Patent Application No. 20783711.3, dated Nov. 25, 2022.

* cited by examiner

HEAT EXCHANGER

FIELD

The present invention relates to a heat exchanger, and relates particularly to a heat exchanger used in an air conditioner.

BACKGROUND

There has been conventionally known a heat exchanger having a structure in which both ends of a flat tube (heat transfer tube) having a plurality of flow path holes are connected to a header, and flow divergence of refrigerant to the flat tube is performed in the header. A plurality of flat tubes is stacked in a direction vertical to a refrigerant flow direction. In such a heat exchanger, in a case where a refrigerant flow speed inside the header is low, retention of liquid refrigerant occurs in a lower part the header due to the influence of gravitational force. On the other hand, in a case where a refrigerant flow speed inside the header is high, retention of liquid refrigerant occurs in an upper part of the header. It is therefore impossible to uniformly diverge a flow of refrigerant. In addition, a plurality of flow path holes is provided inside the flat tube. Because a difference in heat exchange amount is generated between a windward side and a leeward side of the flat tube, the state of refrigerant becomes non-uniform between the plurality of flow paths inside the flat tube, and heat-exchange capability declines.

In view of the foregoing, Patent Literature 1 discloses a heat exchanger 5A including, as illustrated in FIG. 5A, an orifice 151A (ejection hole) provided on an inflow plate 15A that separates a refrigerant inflow portion 14A and a circulation portion 16A of a header 12A, a dividing plate 161A that is arranged parallel to a direction in which flat tubes are stacked, and divides the circulation portion 16A inside the header 12A into spaces on an internal side 16*i*A (side to which flat tubes are connected) and an external side 16*o*A (opposite side of flat tubes), an upper accessway 162A provided above the dividing plate 161A, and a lower accessway 163A provided below the dividing plate 161A. Note that FIGS. 5B, 6B, and 7B illustrate cross-sectional diagrams of the header 12 in FIGS. 5A, 6A, and 7A. In Patent Literature 1, while suppressing liquid refrigerant retention in a lower part of the circulation portion 16A by increasing flow speed of liquid refrigerant flowing into the refrigerant inflow portion 14A from an inflow tube 13A, by the orifice 151A, retention in an upper part is also suppressed by returning liquid refrigerant that has circulated in the circulation portion 16A divided by the upper accessway 162A and the lower accessway 163A, and the dividing plate 161A, and has moved to the upper part of the circulation portion 16A, to the lower part (flow of refrigerant is indicated by an arrow in the drawing). Nevertheless the configuration of Patent Literature 1 has such a problem that it is impossible to improve non-uniformity of the state of the refrigerant between the windward side and the leeward side of a flat tube 11A.

Thus, as illustrated in FIGS. 6A and 6B, it is considered to employ a configuration of a heat exchanger 5B including a first dividing plate 161B that divides a circulation portion 16B inside a header 12B into spaces on an internal side 16*i*B being a flat tube 11B side, and an external side 16*o*B being an opposite side of the flat tube 11B side, a second dividing plate 164B that further divides the space on the external side 16*o*B into a space on a windward side 16*uo*B and a space on a leeward side 16*do*B, an upper accessway 162B provided above the second dividing plate 164B, a lower accessway 163B provided below the second dividing plate 164B, and gaps 165B and 166B provided on the side surfaces of the first dividing plate 161B.

In this configuration, while suppressing liquid refrigerant retention in a lower part of the circulation portion 16B by increasing flow speed of liquid refrigerant flowing into a refrigerant inflow portion 14B from an inflow tube 13B, by an orifice 151B of an inflow plate 15B, retention of refrigerant in an upper of the header 12B is suppressed by returning liquid refrigerant that has circulated in the circulation portion 16B divided by the upper accessway 162B and the lower accessway 163B, and the second dividing plate 164B, and has moved to the upper part of the circulation portion 16B, to the lower part. In the drawing, a flow of refrigerant on the windward side 16*uo*B is indicated by a broken like arrow, and a flow of refrigerant on the leeward side 16*do*B is indicated by a solid line arrow.

Furthermore, in the header 12B, because the space on the external side 16*o*B and the space on the internal side 16*i*B are connected through the gaps 165B and 166B of the first dividing plate 161B, the refrigerant gradually flows to the space on the internal side 16*i*B while circulating. With this structure, on a return side (windward side 16*uo*B) of a circulation route, a flow speed becomes slower, and a larger amount of liquid refrigerant can be flowed to the windward side of the internal side 16*i*B via the gap 165B. Thus, in addition to the effect of Patent Literature 1, non-uniformity of the state of the refrigerant between the windward side and the leeward side of the flat tube 11B can be improved. Nevertheless, in this structure, as illustrated in FIGS. 7A and 7B, there is concern that liquid refrigerant R is retained (indicated by hatching) near the lower accessway 163B in a return side space of the circulation route, and drifts to the flat tube 11B. Note that, in FIG. 7A, the illustration of a part of the flat tube 11B is omitted.

CITATION LIST

Patent Literature

Patent Literature 1: JP2015-127618 A

SUMMARY

Technical Problem

The present invention has been devised in view of the above-described problematic point, and aims to provide a heat exchanger that uniformizes flow divergence of refrigerant to each flat tube, improves non-uniformity of the state of the refrigerant between the windward side and the leeward side of the flat tube, and suppresses drift of liquid refrigerant retained in a return side space of circulation, to the flat tube.

Solution to Problem

According to an aspect of an embodiment, a heat exchanger includes a plurality of flat tubes that stack in a direction vertical to a flow direction of refrigerant flowing inside thereof, a header to which the plurality of flat tubes is connected at one end, an inflow plate that separated a refrigerant inflow portion and a lower circulation portion provided above the refrigerant inflow portion in the header, a vertical dividing plate that separated the lower circulation portion and an upper circulation portion provided above the lower circulation portion in the header, a lower dividing plate that is extending parallel to a stack direction of the flat tubes, in an ascent path on an internal side and a descent path of an external side of the lower circulation portion, a lower accessway that connects the ascent path and the descent path of the lower circulation portion between the inflow plate and the lower dividing plate, an upper dividing plate that is extending parallel to the stack direction of the flat tubes, in an ascent path provided on at least part of a leeward side, and a descent path provided at least on a windward side of the upper circulation portion, and an upper accessway that connects the ascent path and the descent path of the upper circulation portion, wherein the inflow plate includes an ejection hole that ejects refrigerant, on a leeward side and an internal side, and the vertical dividing plate includes a first passing port that lets refrigerant through, on a leeward side and an internal side, and a second passing port that lets refrigerant through, at least on a windward external side.

Advantageous Effects of Invention

According to the present invention, it is possible to provide a heat exchanger that uniformizes flow divergence of refrigerant to each flat tube, improves non-uniformity of the state of the refrigerant between the windward side and the leeward side in the flat tube, and suppresses drift of liquid refrigerant retained in a return side space of circulation, to the flat tube.

DESCRIPTION OF EMBODIMENTS

Embodiment

Hereinafter, a mode for carrying out the present invention (hereinafter, referred to as an "embodiment") will be described in detail based on the attached drawings. Note that, throughout all parts of the description of the embodiment, the same components are assigned the same number.

First Embodiment

First of all, a first embodiment of the present invention will be described using FIGS. 1 to 4B.

(Overall Configuration of Air Conditioner)

Figure 1:
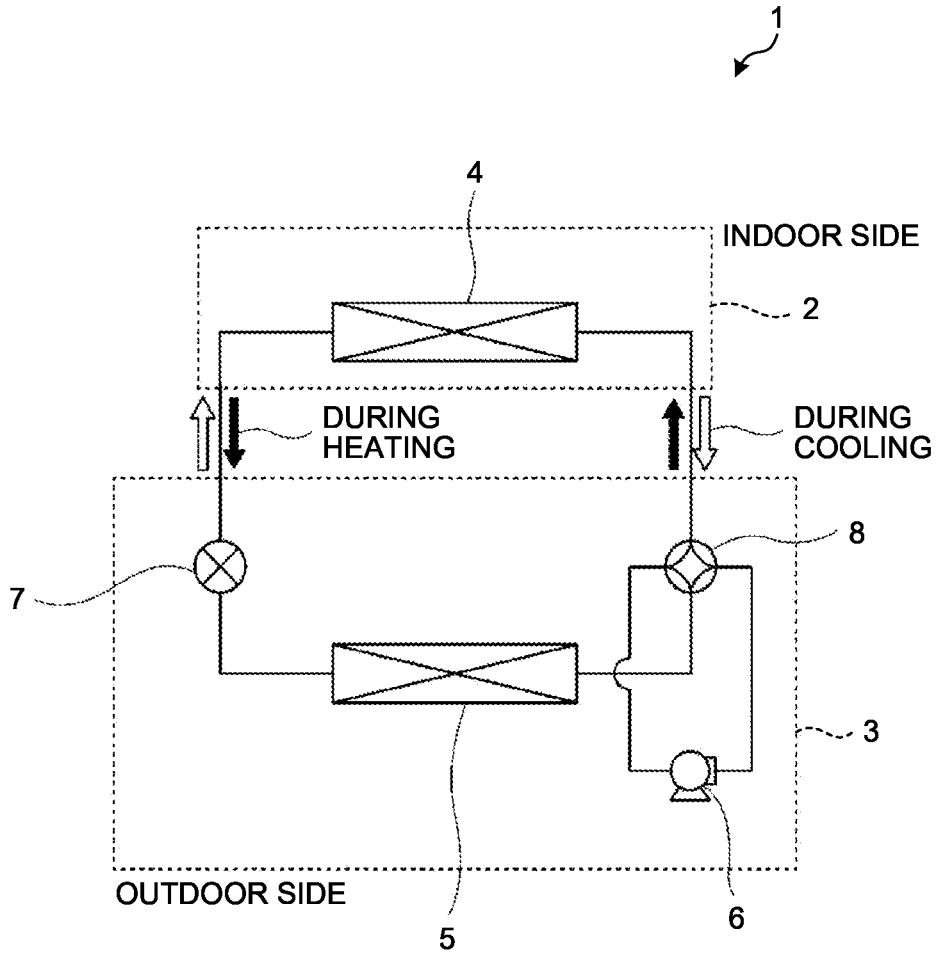
FIG. 1 is a diagram describing a configuration of an air conditioner to which a heat exchanger according to a first embodiment of the present invention is applied.

FIG. 1 illustrates a configuration of an air conditioner to which a heat exchanger according to the first embodiment of the present invention is applied. As illustrated in FIG. 1, an air conditioner 1 includes an indoor unit 2 and an outdoor unit 3. An indoor heat exchanger 4 is provided in the indoor unit 2, and an outdoor heat exchanger 5, a compressor 6, an expansion valve 7, a four-way valve 8, and the like are provided in the outdoor unit 3.

During a heating operation, high-temperature and high-pressure gas refrigerant ejected from the compressor 6 of the outdoor unit 3 flows into the indoor heat exchanger 4 via the four-way valve 8. In the drawing, refrigerant flows in a direction indicated by a black arrow. During a heating operation, the indoor heat exchanger 4 functions as a condenser, and refrigerant heat-exchanged with air condenses and liquefies. After that, high-pressure liquid refrigerant is depressurized by passing through the expansion valve 7 of the outdoor unit 3, and becomes low-temperature and low-pressure air-liquid two-phase refrigerant to flow into the outdoor heat exchanger 5. The outdoor heat exchanger 5 functions as an evaporator, and refrigerant heat-exchanged with outside air gasifies. After that, low-pressure gas refrigerant is sucked into the compressor 6 via the four-way valve 8.

During a cooling operation, high-temperature and high-pressure gas refrigerant ejected from the compressor 6 of the outdoor unit 3 flows into the outdoor heat exchanger 5 via the four-way valve 8. In the drawing, refrigerant flows in a direction indicated by an open arrow. The outdoor heat exchanger 5 functions as a condenser, and refrigerant heat-exchanged with outside air condenses and liquefies. After that, high-pressure liquid refrigerant is depressurized by passing through the expansion valve 7 of the outdoor unit 3, and becomes low-temperature and low-pressure air-liquid two-phase refrigerant to flow into the indoor heat exchanger 4. The indoor heat exchanger 4 functions as an evaporator, and refrigerant heat-exchanged with air gasifies. After that, low-pressure gas refrigerant is sucked into the compressor 6 via the four-way valve 8.

(Heat Exchanger)

The heat exchanger of this first embodiment can be applied to the indoor heat exchanger 4 and the outdoor heat exchanger 5, but the following description will be given assuming that the heat exchanger is applied to the heat exchanger 5 of the outdoor unit 3 that functions as an evaporator during a heating operation. Note that the heat exchanger 5 of the outdoor unit 3 may be used in a flat shape or may be used in an L-shape in a planar view. Normally, in a case where the heat exchanger 5 is used in an L-shape in a planar view, the heat exchanger 5 can be obtained by performing a bending work of the heat exchanger 5 formed in a flat shape. Specifically, an L-shaped heat exchanger 5 is manufactured through an assembly process of assembling the flat-shaped heat exchanger 5 using members to which brazing filler metal is applied to the surface, a brazing process of brazing the assembled flat-shaped heat exchanger 5 into a furnace, and a bending process of bending the brazed flat-shaped heat exchanger 5 into an L-shape. Hereinafter, the heat exchanger of the present invention will be described as a flat-shaped heat exchanger 5.

Figure 2A:
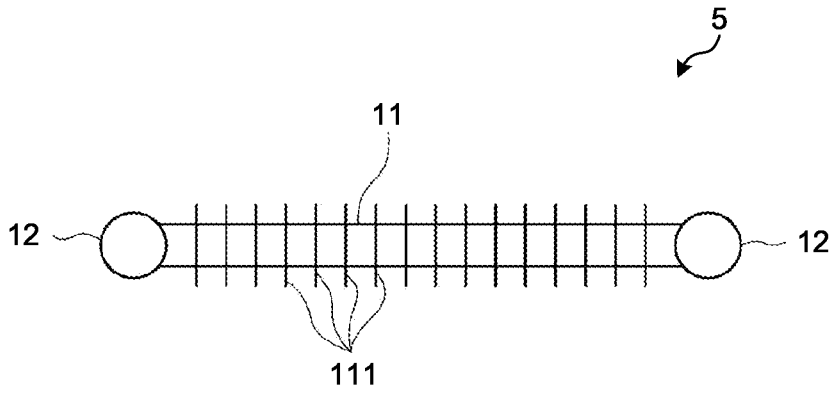
FIG. 2A is a diagram describing the heat exchanger according to the first embodiment of the present invention, and is a plan view illustrating the heat exchanger.
Figure 2B:
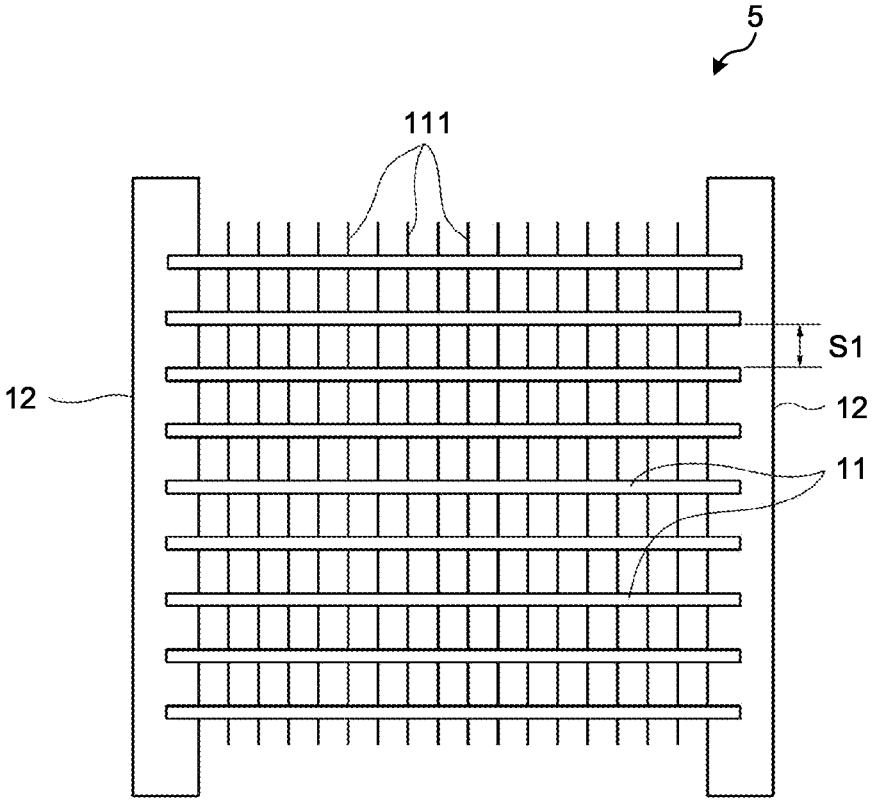
FIG. 2B is a front view illustrating the heat exchanger.

FIGS. 2A and 2B are diagrams describing the heat exchanger 5 according to this first embodiment, and FIG. 2A illustrates a plan view of the heat exchanger 5 and FIG. 2B illustrate a front view of the heat exchanger 5. Flat tubes 11 (first flat tube 11*a* and second flat tube 11*b*) each have a flat cross section extending in a direction in which air flows, and a plurality of flow paths through which refrigerant flows is formed inside the flat tubes 11 with being arranged in an air flowing direction. The heat exchanger 5 includes a plurality of flat tubes 11 arrayed vertically in such a manner that wide ranging surfaces (wide surfaces) of sides of the flat tubes 11 face, a pair of left and right headers 12 connected to the both ends of the flat tubes 11, and a plurality of fins 111 arranged in a direction intersecting with the flat tubes 11 and bonded with the flat tubes 11. In the heat exchanger 5, aside from these, a refrigerant pipe through which refrigerant flows is provided on the header 12 for connecting with the other components of the air conditioner 1.

The flat tubes 11 are arranged vertically in parallel via intervals S1 for letting air through, and the both ends are connected to the pair of headers 12. Specifically, the plurality of flat tubes 11 extending horizontally are arrayed vertically at predetermined intervals S1, and the both ends are connected to the header 12.

The header 12 has a cylindrical shape. Inside the header 12, refrigerant flow paths (not illustrated) for flowing refrigerant supplied to the heat exchanger 5 to be branched into the plurality of flat tubes 11, and joining refrigerant flowing out from the plurality of flat tubes 11 are formed.

The fins 111 have a flat plate shape arranged with extending in a direction intersecting with the flat tubes 11 in a front view, and are arrayed horizontally at predetermined array pitches via intervals for letting air through.

(Header)

Next, the header 12 of the heat exchanger 5 according to this first embodiment will be described using FIGS. 3A, 3B, 3C, 3D, 3E, 4A, and 4B. As illustrated in FIGS. 2A and 2B, the pair of left and right headers 12 are provided. The following description will be given using the left header 12. In addition, in this first embodiment, with respect to the header 12, a flat tube 11 side (right side in the drawing) of a lower dividing plate 161 to be described below will be referred to as an internal side, and an opposite side (left side in the drawing) thereof will be referred to as an external side. In addition, an upper side in the drawing of an upper dividing plate 174 to be described below will be referred to as windward, and an opposite side thereof will be referred to as leeward (lower side in the drawing). Note that, in FIGS. 3A and 4A, the fins 111 are omitted. In addition, a down-pointing arrow in an upper part of a cross-sectional diagram indicates a flowing direction of air.

Figure 3A:
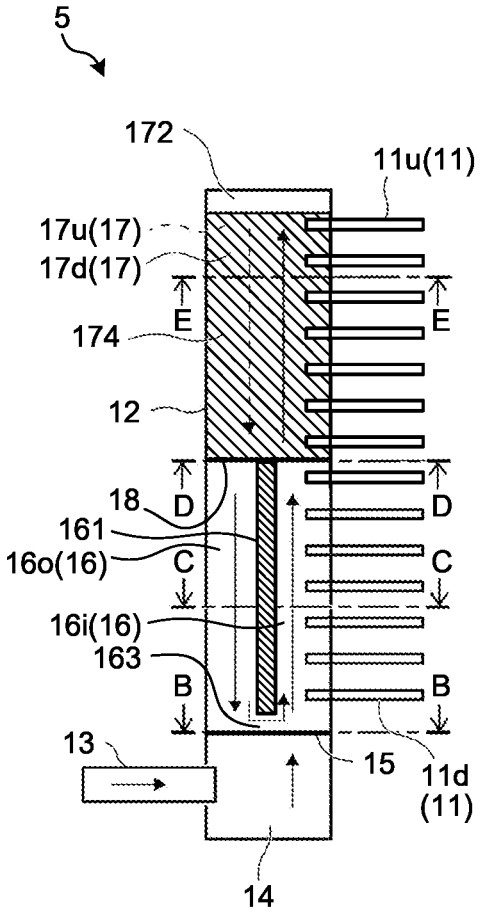
FIG. 3A is a diagram describing a header of the heat exchanger according to the first embodiment of the present invention.
Figure 3B:
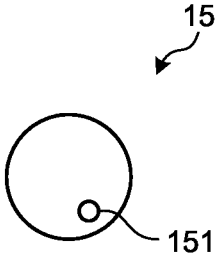
FIG. 3B is a plan view illustrating a B-B line cross section of FIG. 3A, and illustrating an inflow plate.

An internal structure of the header 12 will be described using a schematic diagram in FIG. 3A. The header 12 is formed into a hollow shape in such a manner that refrigerant is diverged into the plurality of flat tubes 11. The header 12 is compartmented into a refrigerant inflow portion 14, a lower circulation portion 16, and an upper circulation portion 17 in order from below. Note that FIGS. 3B, 3C, 3D, and 3E illustrate cross-sectional diagrams of the header 12 in FIG. 3A viewed from a stack direction of the flat tubes, and FIG. 4B illustrates a cross-sectional diagram of the header 12 in FIG. 4A viewed from the stack direction of the flat tubes.

An inflow tube 13 into which refrigerant flows is connected to the refrigerant inflow portion 14. The plurality of flat tubes 11 stacked in a direction vertical to a flow direction of refrigerant flowing in the flat tubes 11 is connected to the header 12 at their one ends, and is classified into a lower flat tube group 11*d* connected to the lower circulation portion 16, and an upper flat tube group 11*u* connected to the upper circulation portion 17. Inside the flat tube 11, a plurality of flow path holes (not illustrated) through which refrigerant flows is arranged in parallel to each other from the windward side to the leeward side.

The refrigerant inflow portion 14 and the lower circulation portion 16 provided above the refrigerant inflow portion 14 are compartmented by an inflow plate 15. On the inflow plate 15, an ejection hole 151 (orifice) through which refrigerant is ejected from the refrigerant inflow portion 14 toward the lower circulation portion 16 is provided. As illustrated in FIG. 3B, in a cross-sectional view in which the inflow plate 15 is viewed from a stack direction of flat tubes, the ejection hole 151 is provided on the leeward side and the internal side of the inflow plate 15, and is located between the lower dividing plate 161 to be described below and one end side of the flat tube 11. Because the ejection hole 151 is arranged at a position not overlapping the one end side of the flat tube 11, it is possible to prevent refrigerant ejected from the ejection hole 151 toward the lower circulation portion 16, from being decelerated by the flat tube 11.

Figure 3C:
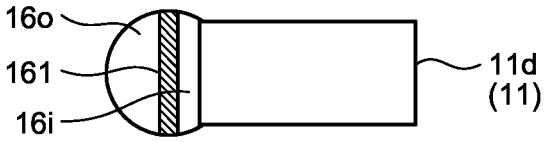
FIG. 3C is a cross-sectional diagram illustrating a C-C line cross section of FIG. 3A.

As illustrated in FIG. 3C, excluding a lower accessway 163, the lower circulation portion 16 is divided by the lower dividing plate 161 into an ascent path 16*i* of refrigerant being an internal side (the flat tube 11B side of the lower circulation portion 16), and a descent path 16*o* of refrigerant being an external side (opposite side of the flat tube 11B side of the lower circulation portion 16). In other words, the lower dividing plate 161 is arranged with extending downward in the stack direction of flat tubes from a vertical dividing plate 18 to be described below, in such a manner as to divide the lower circulation portion 16 into the internal side and the external side, and the internal side and the external side are connected with each other via the lower accessway 163 at a lower end of the lower dividing plate 161. Here, the lower end of the lower dividing plate 161 is located inferiorly to the lowermost flat tube 11 of the lower flat tube group 11*d*.

Figure 3D:
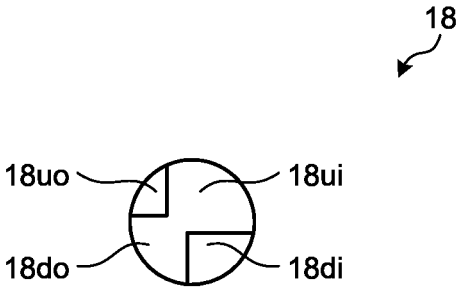
FIG. 3D is a plan view illustrating a D-D line cross section of FIG. 3A, and illustrating a vertical dividing plate.

The lower circulation portion 16 and the upper circulation portion 17 provided above the lower circulation portion 16 are compartmented by the vertical dividing plate 18. As illustrated in FIG. 3D, the vertical dividing plate 18 includes a first passing port 18*di* that lets through refrigerant flowing on the ascent path 16*i*, toward the upper circulation portion 17, and is provided on the leeward side and the internal side of the header 12, and a first closed portion 18*ui* that does not let through refrigerant, and is provided on the windward side and the internal side. In addition, the vertical dividing plate 18 includes a second passing port 18*uo* that lets through refrigerant from the upper circulation portion 17 toward the lower circulation portion 16, and is provided on the windward side and the external side of the header 12, and a second closed portion 18*do* that does not let through refrigerant, and is provided on the leeward side and the external side.

Note that, the second closed portion 18*do* needs not be configured to close a flow path, and may be opened integrally with the second passing port 18*uo*. Even if the second passing port 18*uo* is provided only on the windward side and the external side, or even if the second passing port 18*uo* is provided on the external side from the windward toward the leeward, it is sufficient that the second passing port 18*uo* can guide refrigerant to the descent path 16*o* on the external side of the lower circulation portion 16. In short, it is sufficient that the vertical dividing plate 18 includes the second passing port 18*uo* that lets refrigerant through in a descending direction, at least on the windward external side.

Figure 3E:
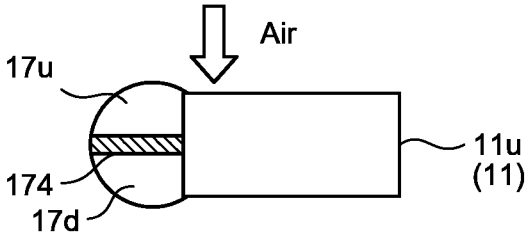
FIG. 3E is a cross-sectional diagram illustrating an E-E line cross section of FIG. 3A.

As illustrated in FIG. 3E, excluding an upper accessway 172, the upper circulation portion 17 is divided by an upper dividing plate 174 into an ascent path 17*d* on the leeward side of the header 12, and a descent path 17*u* on the windward side. In other words, the upper dividing plate 174 is arranged with extending upward in the stack direction of flat tubes from the above-described vertical dividing plate 18, in such a manner as to divide the upper circulation portion 17 into the windward side and the leeward side. The windward side and the leeward side are connected with each other via the upper accessway 172 at an upper end of the upper dividing plate 174. On the upper dividing plate 174, a recessed portion is provided at a point corresponding to the upper flat tube group 11*u*, and the flat tube 11 is inserted thereinto. Here, the upper end of the upper dividing plate 174 is located superiorly to the uppermost flat tube 11 of the upper flat tube group 11*u*.

Here, FIG. 3A illustrates an example in which the lower flat tube group 11*d* and the upper flat tube group 11*u* each include seven flat tubes 11, but the number of flat tubes 11 in each flat tube group is not limited to this. In addition, the number of flat tubes 11 needs not be the same number between flat tube groups provided across the vertical dividing plate 18. In addition, it is sufficient that cross-sectional areas of the ascent path 16*i*, the descent path 16*o*, the ascent path 17*d*, and the descent path 17*u* are preliminarily designed in accordance with the state and type of flowing refrigerant. These items can be appropriately set in accordance with demanded performance of the heat exchanger 5.

(Circulation of Refrigerant)

With the above-described structure of the header 12, while circulating inside the header 12 as indicated by arrows in FIG. 3A, refrigerant is diverged into the flat tubes 11 of the lower flat tube group 11*d* and the upper flat tube group 11*u*. In other words, refrigerant is initially ejected from the refrigerant inflow portion 14 toward the ascent path 16*i* on the internal side of the lower circulation portion 16 via the ejection hole 151 of the inflow plate 15. After that, refrigerant is guided to the ascent path 17*d* on the leeward side of the upper circulation portion 17 via the first passing port 18*di* of the vertical dividing plate 18.

Then, refrigerant turns around at the upper accessway 172, and as indicated by a broken like arrow in FIG. 3A, returns to the descent path 17*u* on the windward side of the upper circulation portion 17. After that, refrigerant is guided to the descent path 16*o* on the external side of the lower circulation portion 16 via the second passing port 18*uo* of the vertical dividing plate 18. At this time, as described above, the second passing port 18*uo* of the vertical dividing plate 18 may be provided only on the windward side and the external side of the header 12, or may be provided on the external side from the windward side toward the leeward side. In short, it is sufficient that the second passing port 18*uo* can guide refrigerant to the descent path 16*o* on the external side of the lower circulation portion 16.

Refrigerant guided to the descent path 16*o* on the external side of the lower circulation portion 16 turns around at the lower accessway 163, and circulates again to the ascent path 16*i* on the internal side of the lower circulation portion 16. Refrigerant joins refrigerant flowing into the lower circulation portion 16 via the ejection hole 151 of the inflow plate 15, and is diverged into the flat tubes 11. Here, areas of the ejection hole 151, the first passing port 18*di*, and the second passing port 18*uo* can be appropriately set in accordance with demanded performance of the heat exchanger 5.

As described above, by refrigerant circulating, in the header 12 according to this first embodiment, flow divergence balance of refrigerant of each flat tube 11 can be uniformized. In other words, because a flow path cross-sectional area is decreased by the ejection hole 151 of the inflow plate 15, the lower dividing plate 161 dividing the lower circulation portion 16, and the upper dividing plate 174 dividing the upper circulation portion 17, and a flow speed of refrigerant increases, liquid refrigerant easily moves upward in the header 12 even with a low circulation amount, and retention of refrigerant in a lower part of the header 12 is suppressed. On the other hand, as for refrigerant that has ascended, because a circulation route for returning liquid refrigerant that has moved to the upper circulation portion 17, to the position of the inflow plate 15 is formed from the upper accessway 172 of the upper circulation portion 17 to the lower accessway 163 of the lower circulation portion 16, retention of refrigerant in the upper circulation portion 17 is suppressed even with a high circulation amount.

Furthermore, it becomes possible to improve non-uniformity of the state of the refrigerant between the windward side and the leeward side within the flat tube 11 In other words, by forming a circulation route from the ascent path 16*i* on the internal side and the descent path 16*o* on the external side in the lower circulation portion 16 of the header 12, and bringing the position of the ejection hole 151 of the inflow plate 15 closer to the leeward side, blown-up high flow speed gas is mainly distributed to the leeward side of the ascent path 16*i*, and liquid refrigerant at flow speed lower than the flow speed is mainly distributed to the windward side of the ascent path 16*i*. With this configuration, while liquid refrigerant is equally distributed to flow path holes in the conventional header, in the header 12 according to this first embodiment, a large amount of liquid refrigerant can be flowed to the windward side on which a heat exchange amount is relatively large, and non-uniformity of the state of the refrigerant between the windward side and the leeward side of the flat tube 11 is improved.

In addition, in the upper circulation portion 17, a circulation route from the ascent path 17*d* on the leeward side toward the descent path 17*u* on the windward side is formed, and a rate of liquid refrigerant increases on the descent path 17*u* side being a return pace. Thus, by arranging a flow-in space on the leeward side and a return space on the windward side, large amount of liquid refrigerant can be flowed to the windward side on which a heat exchange amount is relatively large, and non-uniformity of the state of the refrigerant between the windward side and the leeward side of the flat tube 11 is improved.

Figure 4A:
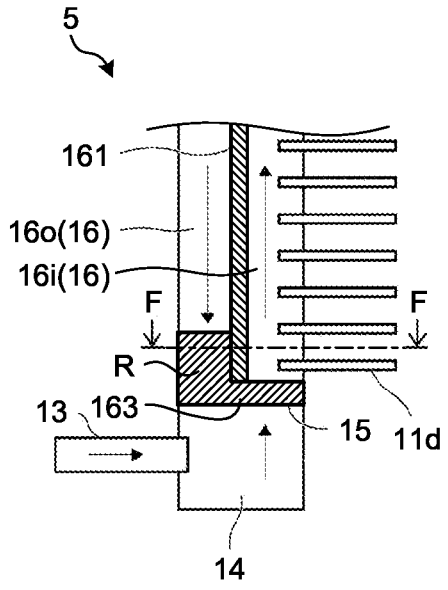
FIG. 4A is a diagram describing retention of liquid refrigerant in the header (lower circulation portion) of the heat exchanger according to the first embodiment of the present invention.
Figure 4B:
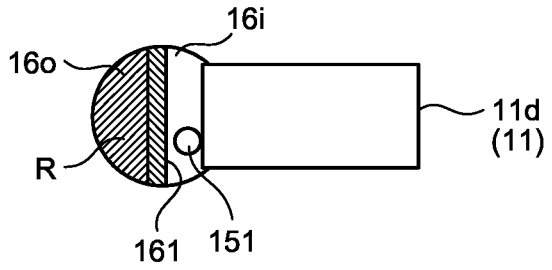
FIG. 4B is a cross-sectional diagram illustrating an F-F line cross section of FIG. 4A.
Figure 5A:
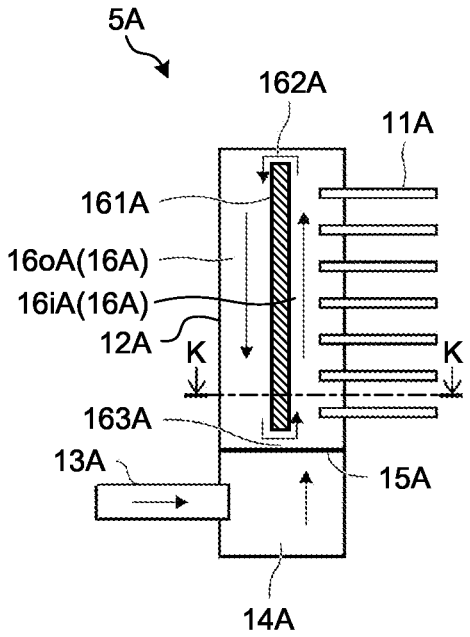
FIG. 5A is a diagram describing an example of a conventional heat exchanger, and is a diagram illustrating a case where a dividing plate that separates an internal side and an external side is included.
Figure 5B:
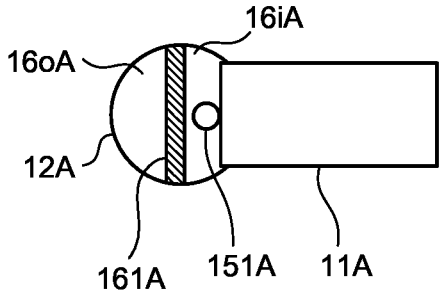
FIG. 5B is a cross-sectional diagram illustrating a K-K line cross section of FIG. 5A.
Figure 6A:
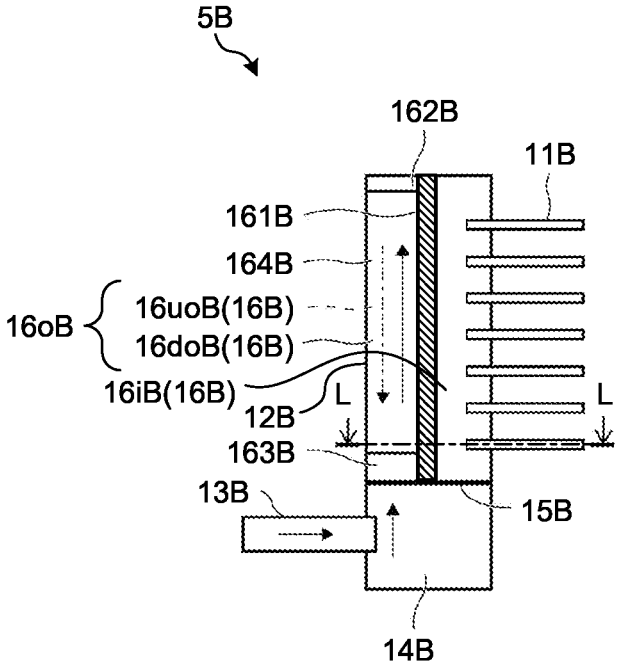
FIG. 6A is a diagram describing another example of a conventional heat exchanger, and is a diagram illustrating a case where a first dividing plate that separates an internal side and an external side, and a second dividing plate that separates a windward side and a leeward side are included.
Figure 6B:
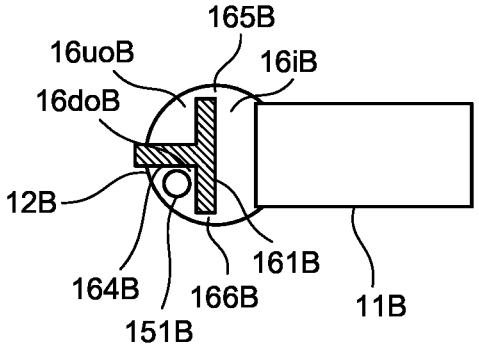
FIG. 6B is a cross-sectional diagram illustrating an L-L line cross section of FIG. 6A.
Figure 7A:
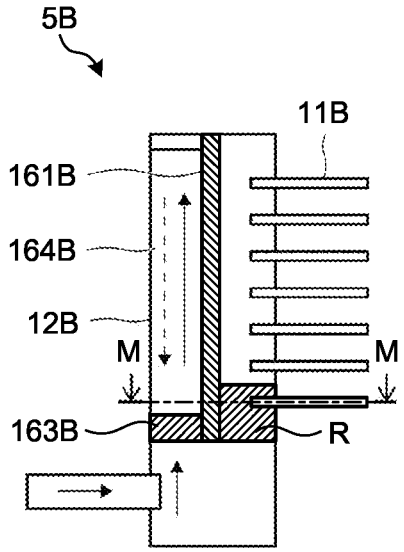
FIG. 7A is a diagram describing retention of liquid refrigerant in FIG. 6.
Figure 7B:
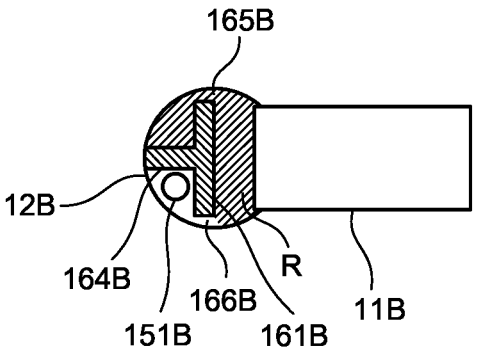
FIG. 7B is a cross-sectional diagram illustrating an M-M line cross section of FIG. 7A.

Furthermore, in the header 12, liquid refrigerant R (indicated by hatching in FIGS. 4A and 4B) retained on the descent path 16*o* being a return space of the circulation route of the lower circulation portion 16 will be described using FIGS. 4A and 4B. As illustrated in FIGS. 4A and 4B, the descent path 16*o* of the lower circulation portion 16 is an external side space to which the flat tubes 11 are not connected, and the retained liquid refrigerant R does not drift to the flat tubes 11. In addition, because the lower end of the lower dividing plate 161 of the lower circulation portion 16 (eventually, the height of the lower accessway 163) is located inferiorly to the lowermost flat tube 11 of the lower flat tube group 11*d*, the liquid refrigerant R is prevented from moving toward the ascent path 16*i*.

Second Embodiment

Next, a second embodiment of the present invention will be described using FIGS. 8A, 8B, 8C, 8D, and 8E. Because the overall configuration of the air conditioner 1 and the heat exchanger 5 are similar to those of the first embodiment, the description of these will be omitted. Note that FIGS. 8B, 8C, 8D, and 8E illustrate cross-sectional diagrams of the header 12 in FIG. 8A viewed from a stack direction of the flat tubes.

(Header)

A header 22 will be described below. The second embodiment is similar to the first embodiment in that the description will be given using a left header 22 of a pair of left and right headers 22, and with respect to the header 22, a flat tube 11 side (right side in the drawing) within the header 22 that is compartmented by a lower dividing plate 261 to be described below will be referred to as an internal side, and an opposite side (left side in the drawing) thereof will be referred to as an external side, and an upper side in the drawing of an upper dividing plate 274 to be described below will be referred to as windward, and an opposite side thereof will be referred to as leeward (lower side in the drawing), and the fins 111 are omitted in FIG. 8A.

The second embodiment aims to enable flow divergence of liquid refrigerant to be appropriately performed in the descent path 17*u* (space in which refrigerant returns to a lower part) of the upper circulation portion 17 in the first embodiment in a situation in which a circulation amount of refrigerant is large.

For dealing with such a situation, the header 22 includes the upper dividing plate 274 provided in an upper circulation portion 27. The upper dividing plate 274 has an L-shaped cross-sectional shape when viewed in a cross section vertical to the stack direction of flat tubes as illustrated in FIG. 8B. Specifically, the upper dividing plate 274 is formed by combining a first dividing portion 274*x* dividing the internal side of the upper circulation portion 27 into the windward side and the leeward side, and a second dividing portion 274*y* dividing the leeward side of the header 22 into the external side and the internal side. While the second dividing portion 274*y* is arranged with extending from a vertical dividing plate 28 to an upper end of the upper circulation portion 27, the first dividing portion 274*x* is provided up to a position inferior to at least the uppermost flat tube of the upper flat tube group 11*u*, and an upper accessway 272 is provided between an upper end of the upper circulation portion 27. On the first dividing portion 274*x*, a recessed portion is provided at a point corresponding to the upper flat tube group 11*u*, and the flat tube 11 is inserted thereinto.

By the upper dividing plate 274, the upper circulation portion 27 is divided into an ascent path 27*di* of refrigerant on the leeward side and the internal side, a descent path 27*u* of refrigerant on the windward side, and a descent path 27*do* of refrigerant on the leeward external side. The descent path 27*u* and the descent path 27*do* are formed as an integrated space.

As described above, in the header 22 according to the second embodiment, the upper circulation portion 27 is divided in such a manner that the leeward side and the internal side corresponding to a partial space on the leeward side of the upper circulation portion 27 is divided into the ascent path 27*di*, and a space obtained by adding a partial space on the leeward side and the external side to all spaces on the windward side is divided into the descent paths 27*u* and 27*do*. Thus, if the header 12 and the header 22 are summarized, the upper dividing plate 174 or 274 divides the upper circulation portion 17 or 27 excluding the upper accessway 172 or 272, into the ascent path 17*d* or 27*di* provided on at least part of the leeward side, and the descent path 17*u*, or 27*u*/27*do* provided at least on the windward side.

(Circulation of Refrigerant)

Figure 8A:
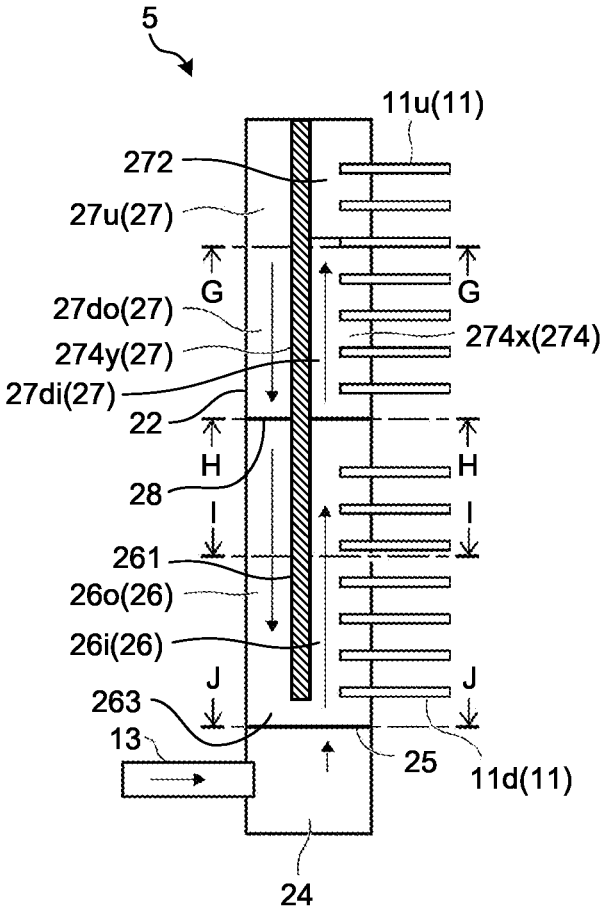
FIG. 8A is a diagram describing a header of a heat exchanger according to a second embodiment of the present invention.
Figure 8B:
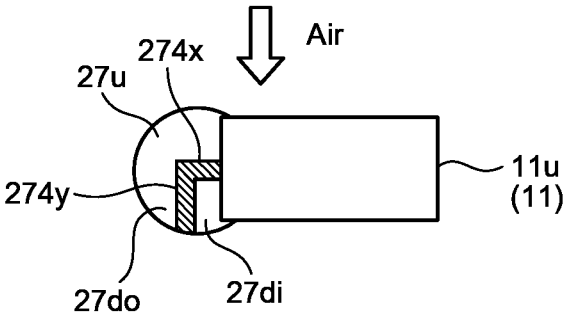
FIG. 8B is a cross-sectional diagram illustrating a G-G line cross section of FIG. 8A.
Figure 8C:
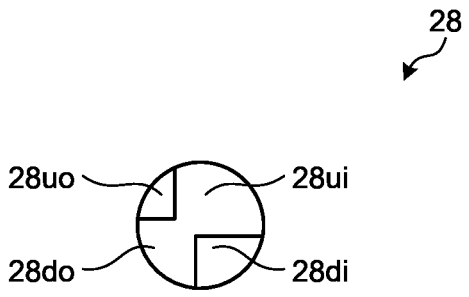
FIG. 8C is a cross-sectional diagram illustrating an H-H line cross section of FIG. 8A.
Figure 8D:
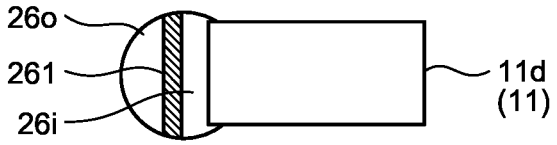
FIG. 8D is a cross-sectional diagram illustrating an I-I line cross section of FIG. 8A.
Figure 8E:
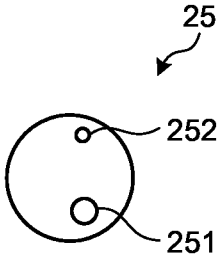
FIG. 8E is a cross-sectional diagram illustrating a J-J line cross section of FIG. 8A.

In the above-described configuration, while circulating inside the header 22 as indicated by arrows in FIG. 8A, refrigerant is diverged into the flat tubes 11 of the lower flat tube group 11*d* and the upper flat tube group 11*u*. In other words, refrigerant is initially ejected from a refrigerant inflow portion 24 toward an ascent path 26*i* on the internal side of a lower circulation portion 26 via an ejection hole 251 on the leeward side and internal side of an inflow plate 25. After that, refrigerant is guided to the ascent path 27*di* on the leeward side and internal side of the upper circulation portion 27 via the first passing port 28*di* of the vertical dividing plate 28. Note that FIG. 8C illustrates an example in which another ejection hole 252 is provided on the windward side and the internal side of the inflow plate 25, but this not indispensable as the second embodiment, and it is sufficient that the ejection hole 252 is provided only in a case where ejection of refrigerant to the lower circulation portion 26 needs to be promoted.

Then, refrigerant turns around at the upper accessway 272, and returns to the descent path 27*u* on the windward side of the upper circulation portion 27 and the descent path 27*do* of the leeward external side. After that, refrigerant is guided to the descent path 26*o* on the external side of the lower circulation portion 26 via the second passing port 28*uo* of the vertical dividing plate 28. At this time, as described above, the second passing port 28*uo* of the vertical dividing plate 28 may be provided only on the windward external side, or may be provided on the external side from the windward side toward the leeward side. In short, it is sufficient that the second passing port 28*uo* can guide refrigerant to the descent path 26*o* on the external side of the lower circulation portion 26.

Refrigerant guided to the descent path 26*o* on the external side of the lower circulation portion 26 turns around at the lower accessway 263, and circulates again to the ascent path 26*i* on the internal side of the lower circulation portion 26.

Here, retention of liquid refrigerant in a situation in which a circulation amount of refrigerant is large will be described. In a case where a circulation amount of refrigerant is large, liquid refrigerant is sometimes retained on the windward side of the vertical dividing plate 28. In view of this, as in the second embodiment, by dividing the upper accessway 272, using the L-shaped upper dividing plate 274, into the ascent path 27*di* on the leeward side and internal side, the descent path 27*u* on the windward side, and the descent path 27*do* on the leeward external side, even if an amount of liquid refrigerant moving downward from the upper accessway 272 through the descent path 27*u* and the descent path 27*do* is too large for passing through the second passing port 28*uo* on the windward external side of the vertical dividing plate 28, the liquid refrigerant is retained while spreading on the vertical dividing plate 28 also in a second closed portion 28*do* on the leeward side and external side in addition to a first closed portion 28*ui* on the windward side and the internal side. As a result, an area in which refrigerant can be retained in the upper circulation portion 27 increases. Thus, retention height of liquid refrigerant can be made lower than the lowermost flat tube 11 of the upper flat tube group 11*u*, and drift in the height direction of the upper flat tube group 11*u* can be further improved (Effect of Embodiment)

By employing the above-described heat exchanger, the first embodiment can uniformize flow divergence of refrigerant to each flat tube 11, improve non-uniformity of the state of the refrigerant between the windward side and the leeward side in the flat tube 11, and suppresses drift of liquid refrigerant retained in the descent path 16*o* (return space of refrigerant) of the lower circulation portion 16, to the flat tube 11.

Furthermore, by increasing a retention area of liquid refrigerant on the descent path 27*u* or 27*do* side of the upper circulation portion 27 while improving drift in a width direction, the second embodiment can suppress influence of retention of liquid refrigerant, and further improve drift in the height direction.

Heretofore, preferred embodiments of the present invention have been described in detail, but the present invention is not limited to the above-described embodiments, and various modifications and changes can be made without departing from the gist of the present invention described in the appended claims.

REFERENCE SIGNS LIST

1 AIR CONDITIONER
2 INDOOR UNIT
3 OUTDOOR UNIT
4 HEAT EXCHANGER (INDOOR)
5 HEAT EXCHANGER (OUTDOOR)
6 COMPRESSOR
11 FLAT TUBE
11*d* LOWER FLAT TUBE GROUP
11*u* UPPER FLAT TUBE GROUP
111 FIN
12 HEADER (FIRST EMBODIMENT)
13 INFLOW TUBE
14 REFRIGERANT INFLOW PORTION
15 INFLOW PLATE
151 EJECTION HOLE (ORIFICE)
16 LOWER CIRCULATION PORTION
16*i* ASCENT PATH ON INTERNAL SIDE
16*o* DESCENT PATH ON EXTERNAL SIDE
161 LOWER DIVIDING PLATE
163 LOWER ACCESSWAY
17 UPPER CIRCULATION PORTION
17*d* ASCENT PATH ON LEEWARD SIDE
17*u* DESCENT PATH ON WINDWARD SIDE
172 UPPER ACCESSWAY
174 UPPER DIVIDING PLATE
18 VERTICAL DIVIDING PLATE
18*di* FIRST PASSING PORT
18*ui* FIRST CLOSED PORTION
18*uo* SECOND PASSING PORT
18*do* SECOND CLOSED PORTION
22 HEADER (SECOND EMBODIMENT)
24 REFRIGERANT INFLOW PORTION
25 INFLOW PLATE
251 EJECTION HOLE (ORIFICE)
26 LOWER CIRCULATION PORTION
26*i* ASCENT PATH ON INTERNAL SIDE
26*o* DESCENT PATH ON EXTERNAL SIDE
261 LOWER DIVIDING PLATE
263 LOWER ACCESSWAY
27 UPPER CIRCULATION PORTION
27*di* ASCENT PATH ON LEEWARD SIDE AND INTERNAL SIDE
27*u* DESCENT PATH ON WINDWARD SIDE
27*do* DESCENT PATH ON LEEWARD EXTERNAL SIDE
272 UPPER ACCESSWAY
274 UPPER DIVIDING PLATE
274*x* FIRST DIVIDING PORTION
274*y* SECOND DIVIDING PORTION
28 VERTICAL DIVIDING PLATE
28*di* FIRST PASSING PORT
28*ui* FIRST CLOSED PORTION
28*uo* SECOND PASSING PORT
28*do* SECOND CLOSED PORTION
R LIQUID REFRIGERANT

The invention claimed is:

1. A heat exchanger comprising:

a plurality of flat tubes that stack in a direction vertical to a flow direction of refrigerant flowing inside thereof;

a header to which the plurality of flat tubes is connected at one end;

an inflow plate that separates a refrigerant inflow portion and a lower circulation portion provided above the refrigerant inflow portion in the header;

a vertical dividing plate that separates the lower circulation portion and an upper circulation portion provided above the lower circulation portion in the header;

a lower dividing plate that is arranged parallel to a stack direction of the plurality of flat tubes to divide the lower circulation portion into a lower ascent path on an internal side and a lower descent path of an external side;

a lower accessway that connects the lower ascent path and the lower descent path of the lower circulation portion between the inflow plate and the lower dividing plate;

an upper dividing plate that is arranged parallel to the stack direction of the plurality of flat tubes to divide the upper circulation portion into an upper ascent path provided on at least part of a leeward side, and an upper descent path provided at least on a windward side; and an upper accessway that connects the upper ascent path and the upper descent path of the upper circulation portion, wherein the inflow plate includes an ejection hole that ejects refrigerant, on a leeward side and an internal side, and the vertical dividing plate includes a first passing port that lets refrigerant through, on a leeward side and an internal side, and a second passing port that lets refrigerant through, at least on a windward external side.

2. The heat exchanger according to claim 1, wherein the ejection hole of the inflow plate is located between the lower dividing plate and one end side of the plurality of flat tubes in a cross-sectional view.

3. The heat exchanger according to claim 1, wherein a lower end of the lower dividing plate of the lower circulation portion is located inferiorly to a lowermost flat tube of the plurality of flat tubes.

4. The heat exchanger according to claim 1, wherein the upper dividing plate is formed by a first dividing portion that divides an internal side of the upper circulation portion into windward and leeward, and a second dividing portion that divides a leeward side of the upper circulation portion into an external side and an internal side, in such a manner that a cross-section becomes an L-shape, and the upper ascent path is arranged on a leeward side and an internal side, and the upper descent path is arranged on a windward side or a leeward external side.

* * * * *